US008042502B2

(12) United States Patent
Schnell

(10) Patent No.: US 8,042,502 B2
(45) Date of Patent: Oct. 25, 2011

(54) VALVE DRIVE FOR AN INTERNAL COMBUSTION ENGINE, IN PARTICULAR WITH A DECOMPRESSION BRAKE

(75) Inventor: Oliver Schnell, Veitsbronn (DE)

(73) Assignee: Schaeffler KG, Herzogenaurach (DE)

( * ) Notice: Subject to any disclaimer, the term of this patent is extended or adjusted under 35 U.S.C. 154(b) by 291 days.

(21) Appl. No.: 12/537,335

(22) Filed: Aug. 7, 2009

(65) Prior Publication Data

US 2010/0031907 A1 Feb. 11, 2010

(30) Foreign Application Priority Data

Aug. 8, 2008 (DE) ..... 10 2008 037 158

(51) Int. Cl.
*F01L 1/34* (2006.01)

(52) U.S. Cl. ..... 123/90.16; 123/90.12; 123/90.44; 123/321

(58) Field of Classification Search ..... 123/90.12, 123/90.15, 90.16, 90.46, 90.39, 321
See application file for complete search history.

(56) References Cited

U.S. PATENT DOCUMENTS

| | | | | |
|---|---|---|---|---|
| 1,931,476 | A * | 10/1933 | Hallett | 123/90.46 |
| 5,682,847 | A * | 11/1997 | Hara | 123/90.16 |
| 6,257,201 | B1 * | 7/2001 | Kajiura et al. | 123/321 |
| 2009/0107428 | A1 * | 4/2009 | Magnan et al. | 123/90.12 |

* cited by examiner

*Primary Examiner* — Thomas Denion
*Assistant Examiner* — Daniel Bernstein
(74) *Attorney, Agent, or Firm* — Lucas & Mercanti, LLP

(57) ABSTRACT

A valve drive with a decompression brake for an internal combustion engine, which has a camshaft with a cam, a rocker arm for transmitting the cam stroke to a gas exchange valve, a pivot bearing supporting the rocker arm, and a hydraulic valve play compensating element arranged in force flow between the cam and gas exchange valve. The valve play compensating element is fixed in the engine and valve drive also has a secondary lever with a first and second lever section. The secondary lever is angularly connected, between the lever sections, to a lever support formed on the rocker arm, is supported with the first lever section on the valve play compensating element and actuates the gas exchange valve by the second lever section. The effective lever arm of the first lever section is considerably greater than the effective lever arm of the second lever section.

10 Claims, 3 Drawing Sheets

VALVE DRIVE FOR AN INTERNAL COMBUSTION ENGINE, IN PARTICULAR WITH A DECOMPRESSION BRAKE

This application claims the priority of DE 10 2008 037 158.0 filed Aug. 8, 2008, and is incorporated by reference herein.

FIELD OF THE INVENTION

The invention relates to a valve drive for an internal combustion engine, in particular with a decompression brake. The valve drive comprises a camshaft with a cam, a rocker arm or oscillating lever for transmitting the cam stroke to a gas exchange valve, a pivot bearing which supports the rocker arm or oscillating lever, and a hydraulic valve play compensating element which is arranged in the force flow between the cam and the gas exchange valve.

BACKGROUND OF THE INVENTION

In valve drives for internal combustion engines with a decompression brake—usually large-volume diesel engines for use in utility vehicles—provision is made for one or all of the outlet valves of a cylinder to be re-opened during the course of the compression stroke in the engine braking mode in order to considerably increase the charge exchange work for the benefit of negative engine power. In relation to the regular outlet valve actuation in the expansion stroke, the re-opening of the outlet as a function of the control times thereof requires significantly greater valve actuating forces, since the outlet valves must open counter to the compression pressure, and occasionally counter to the final compression pressure in the cylinder.

As proposed in U.S. Pat. No. 7,392,772 B2, which is considered to be generic, it is possible in valve drives of said type for the compensation of the valve play to also take place in an automatic and continuously variable fashion by means of a hydraulic valve play compensating element, wherein it is intended for the valve play compensating element to be arranged as an alternative to an adjusting screw, which mechanically adjusts the valve play, between the valve-side lever section of a rocker arm, which is disclosed in said document, and the gas exchange valve. Said positioning of the valve play compensating element can, however, pose problems since the high valve actuating forces during the engine braking mode cause an excessive sinking of the valve play compensating element on account of hydraulic medium being FORCED out of the high-pressure chamber of said valve play compensating element. The regeneration of the valve play compensating element, which is subsequently required, is also hindered by the multiple opening of the outlet valve during a cam rotation, since only a comparatively small zero-stroke cam angle is available for the re-induction of hydraulic medium into the then-expanding high-pressure chamber. One result of this imbalance between the sinking and regeneration of the valve play compensating element can, depending on the duration of the engine braking mode, be a successive complete collapse of the valve play compensating element into its mechanical blocked position, wherein this may be associated both from a thermodynamic aspect and also from a mechanical aspect with inadmissible truncation of the cam elevations for the expansion stroke and the engine braking mode. With regard to the thermodynamics, reference is made to the inadequate charge exchange on account of excessively small valve opening cross sections, and with regard to mechanics, reference is made to the high lift-up and set-down speeds of the gas exchange valves on account of a lack of cam ramps.

Said considerations apply correspondingly to the valve drive proposed in DE 10 2006 031 706 A1, which valve drive has a hydraulic valve play compensating element arranged between a rocker arm and the gas exchange valve.

OBJECT OF THE INVENTION

The object on which the present invention is based is therefore that of ensuring the functional capability of a valve drive of the type mentioned in the introduction. Accordingly, it should be possible even in the event of very high valve actuating forces for the valve drive to be fitted with a hydraulic valve play compensating element of the type known per se for the automatic and continuously variable adjustment of the valve play.

SUMMARY OF THE INVENTION

Said object is achieved by means of the characterizing features of claim 1, while advantageous refinements and embodiments of the invention can be gathered from the subclaims. Accordingly, the valve play compensating element should be arranged in a stationary fashion in the internal combustion engine and the valve drive should also comprise a secondary lever having a first lever section and having a second lever section. Here, the secondary lever is articulatedly connected, between the lever sections, to a lever support formed on the rocker arm or oscillating lever, is supported with the first lever section on the valve play compensating element and actuates the gas exchange valve by means of the second lever section. The effective lever arm of the first lever section is considerably larger than the effective lever arm of the second lever section.

In other words, the invention provides that the valve play compensating element be relocated, in such a way that the valve play compensating element no longer—as proposed in the prior art cited in the introduction—moves together with the gas exchange valve and is no longer directly exposed to the actuating forces thereof, but rather is connected, in a stationary fashion, into the force flow between the cam and gas exchange valve via a force-reducing lever ratio.

In one preferred physical embodiment of the invention with regard to the lever ratio, it is provided that the effective lever arms have a transmission ratio of at least 2:1. For example, in this way, the valve play compensating element would, with a valve actuating force of 15 kN and a transmission ratio of 3:1, be acted on with a force of only 5 kN.

To reduce the assembly expenditure, the rocker arm or oscillating lever and the secondary lever should also be combined to form a captive structural unit. Here, the lever support may be a joint pin which is fastened to side walls of the rocker arm or oscillating lever and which spans the side walls and which, together with a joint eyelet which extends transversely through the secondary lever, forms a pin joint.

According to an exemplary embodiment of the invention which will be explained later, the pivot bearing should also be formed as an axle which runs parallel to the camshaft and which has a hydraulic-medium-conducting duct and a recess which holds the valve play compensating element and which is connected to the duct. A particularly compact embodiment of a valve drive of said type is also provided when the recess for the valve play compensating element is arranged in the axial region of a bearing eyelet, which engages around the axle of the rocker arm or oscillating lever, with the bearing eyelet being provided with a radial opening which serves as a clearance for the valve play compensating element and/or for the first lever section of the secondary lever. The radial opening is preferably formed as a slot which is aligned in the circumferential direction of the bearing eyelet. This may be expedient, for example, if the valve play compensating element projects through the radial opening and guides the rocker arm or oscillating lever in the transverse direction with respect to the axle on the straight inner walls of the radial opening.

In a further embodiment of the invention, the valve drive should also comprise a tappet rod which is arranged, for the purpose of transmission, between the second lever section of the secondary lever and the gas exchange valve. To aid assembly and to prevent detachment of the tappet rod during operation, a valve-side end section of the rocker arm or oscillating lever should be provided with an opening which runs in the direction of the gas exchange valve and through which the tappet rod is guided. Furthermore, both ends of the tappet rod should be designed as joint heads, with the lever-side joint head being held in a joint socket which runs on the second lever section of the secondary lever and with the valve-side joint head being held in a joint socket of a thrust piece which makes contact at the end side with the gas exchange valve.

Finally, if possible and expedient, it should also be possible for the above-stated features to also be combined with one another in any desired manner.

BRIEF DESCRIPTION OF THE DRAWINGS

Further features of the invention can be gathered from the following description and from the drawings which illustrate an exemplary embodiment, showing the components and features which are essential for understanding the invention. In the drawings.

DETAILED DESCRIPTION OF THE DRAWINGS

Figure 1:
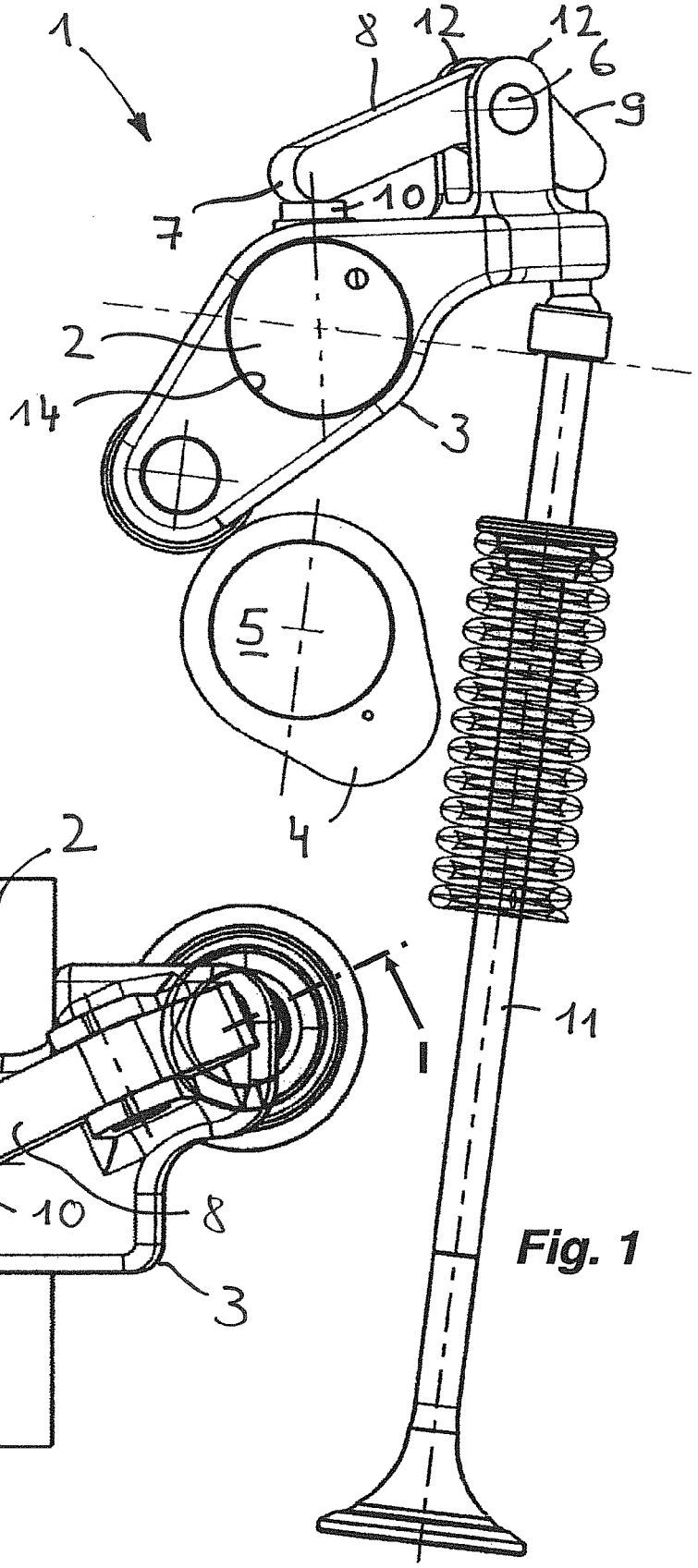
FIG. 1 shows a detail of a rocker arm valve drive in a side view.
Figure 2:
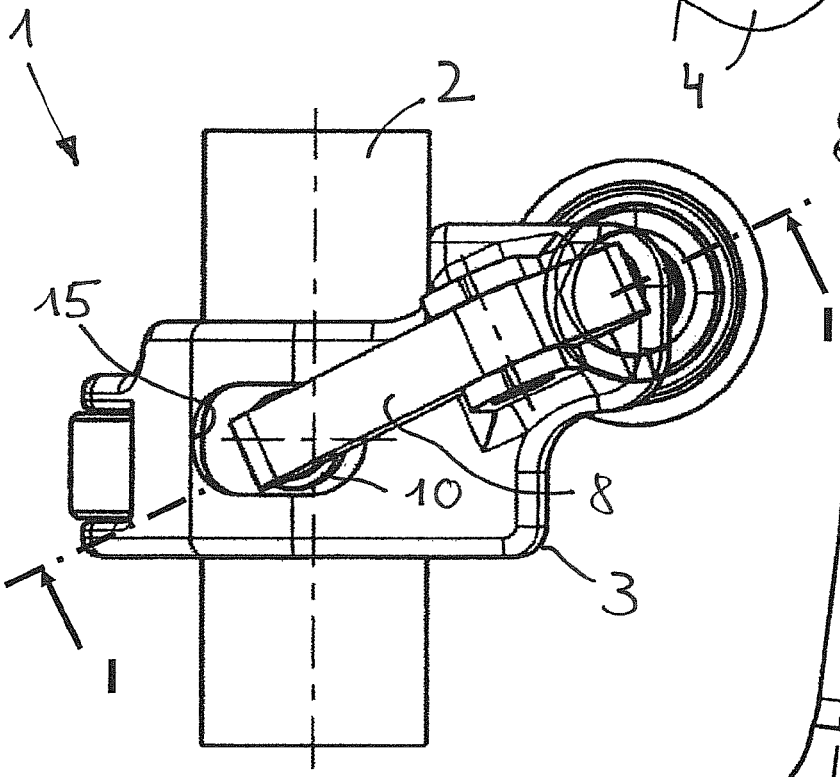
FIG. 2 shows the valve drive as per FIG. 1 in a plan view.

FIGS. 1 and 2 illustrate a valve drive 1 of an internal combustion engine with a decompression brake in a side view and in a plan view respectively A rocker arm 3, which is supported centrally on a pivot bearing 2, is operatively connected at one side to a cam 4 of a camshaft 5 and has, at the other side, a lever support 6 to which a secondary lever 7 is articulatedly connected between its first lever section 8 and its second lever section 9. The secondary lever 7 is supported with the first lever section 8 on a hydraulic valve play compensating element 10 and, with the second lever section 9, actuates an outlet-side gas exchange valve which is spring-loaded in the closing direction and which is referred to for short below as outlet valve 11.

The rocker arm 3 and the secondary lever 7 are combined to form a captive structural unit, by virtue of the lever support 6 being formed as a joint pin which is fastened to projecting side walls 12 of the rocker arm 3 and which spans the side walls 12 and which, together with a joint eyelet 13 (see FIG. 3) which extends transversely through the secondary lever 7, forms a pin joint.

The pivot bearing 2 is a fundamentally known axle which runs parallel to the camshaft 5 and around which a bearing eyelet 14 of the rocker arm 3 engages so as to form a plain bearing. The central axial region of the bearing eyelet 14 is provided with a radial opening 15 which is designed here as a slot which is aligned in the circumferential direction of the bearing eyelet 14 and which, depending on the deployment position of the valve play compensating element 10, serves as a clearance for the valve play compensating element 10 and/or for the first lever section 8 of the secondary lever 7. Furthermore, the width of the slot 15 is dimensioned such that there is only a small degree of axial play to the outer circumference of the valve play compensating element 10, in order to hold the rocker arm 3 in position in the longitudinal direction of the axle 2.

Figure 3:
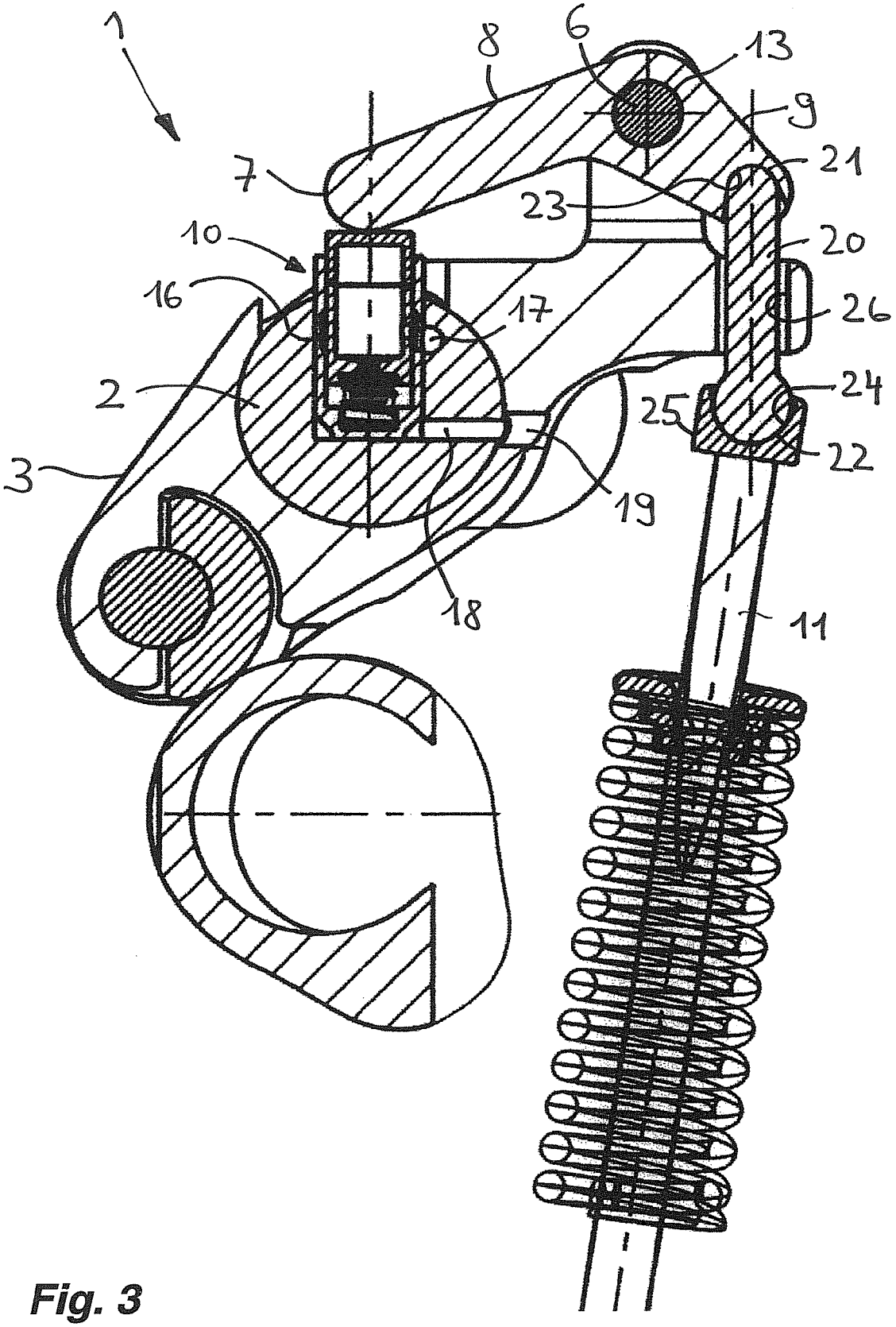
FIG. 3 shows the section I-I as per FIG. 2.

As can be seen from the section I-I shown in FIG. 3, the valve play compensating element 10, which is known per se, is held in a recess 16 of the axle 2 and is supplied with hydraulic medium via a duct 17, which is connected to the lubricant supply of the internal combustion engine and which intersects the recess 16. An axial bore 18, which intersects the base of the recess 16, serves for the release of pressure, which axial bore 18, at least in the zero-stroke position of the rocker arm 3 as shown, communicates via a rocker arm bore 19 with the surroundings of the rocker arm 3.

The actuation of the outlet valve 11 takes place by means of a tappet rod 20 which is arranged between the second lever section 9 of the secondary lever 7 and the outlet valve 11 and the two ends 21, 22 of which are formed as spherical joint heads. Here, the lever-side joint head 21 is held in a joint socket 23 which runs in the second lever section 9, and the valve-side joint head 22 is held in a joint socket 24, of a thrust piece 25 which makes contact at the end side with the outlet valve 11. The joint sockets 23, 24 are of spherical-cap-shaped design.

For simplified assembly of the valve drive 1 and in order to prevent an inadvertent detachment of the tappet rod 20 during operation of the internal combustion engine, the valve-side end section of the rocker arm 3 is provided with an opening 26 which runs in the direction of the outlet valve 11 and through which the tappet rod 20 is guided with the required operating play.

Looking at the secondary lever 7 in FIG. 3, it is also clear that the effective lever arm of the first lever section 8 is significantly larger than the effective lever arm of the second lever section 9, with the effective lever arms having a transmission ratio of approximately 3:1 in the exemplary embodiment shown. The effective lever arms are to be understood to mean in each case the spacing between the lever support 6 and the contact point with respect to the valve play compensating element 10 or to the tappet rod 20, respectively. On account of the transmission ratio, the valve actuating forces which act at the point of contact between the thrust piece 25 and the outlet valve 11 are reduced, in a good approximation, to ⅓ on the side of the supporting valve play compensating element 10, such that the degree to which the valve play compensating element 10 sinks on account of hydraulic medium being forced out can be kept at a comparatively low level even under very high valve actuating forces.

Figure 4:
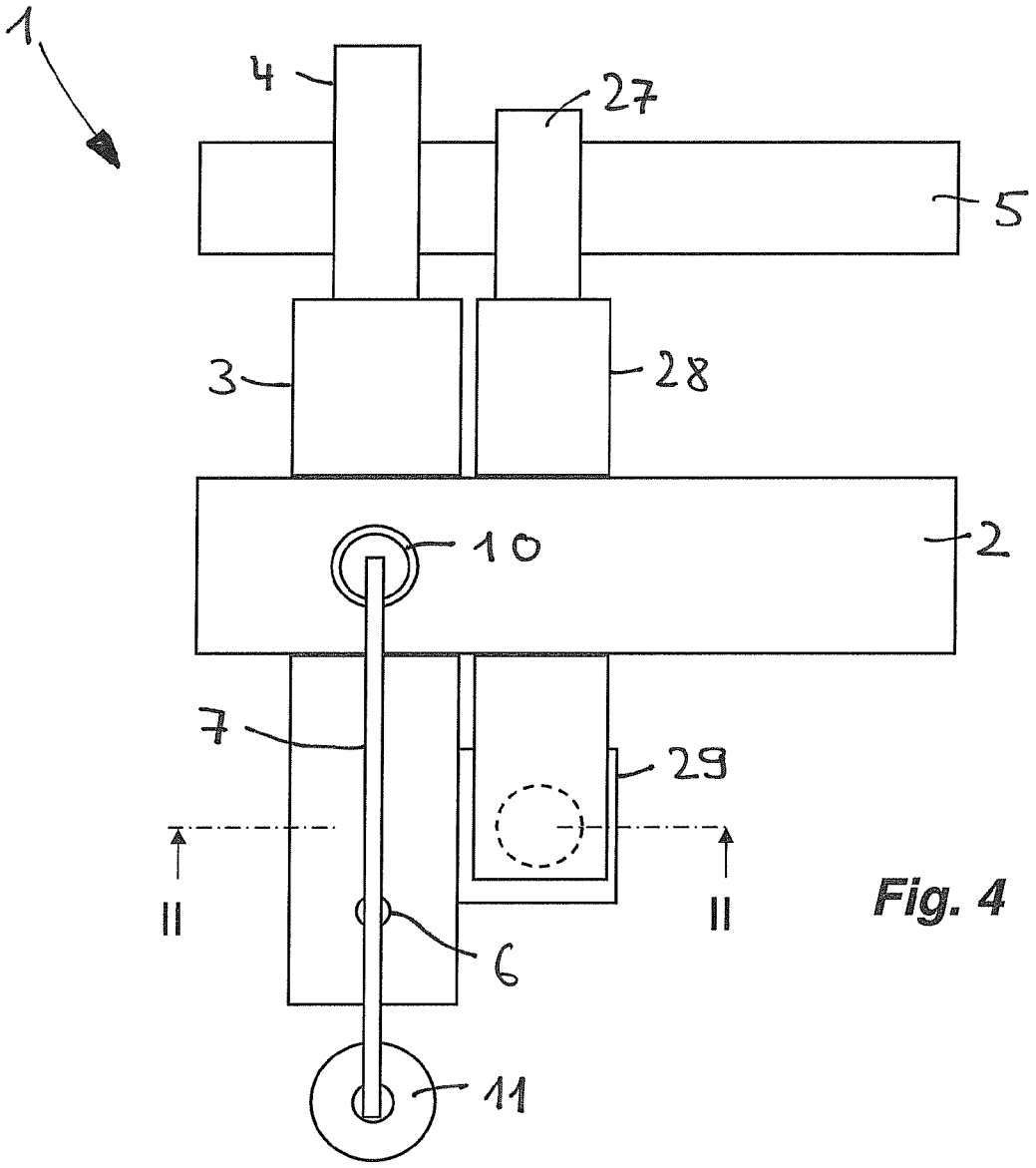
FIG. 4 shows the rocker arm valve drive as per FIG. 1 in a schematic overall illustration.

A schematic overall illustration of the valve drive 1 which is only partially illustrated in the preceding figures is shown in FIG. 4. Aside from the design according to the invention of the rocker arm 3 and of the secondary lever 7 and also the arrangement of the hydraulic valve play compensating element 10, the basic design of the valve drive 1 is known from U.S. Pat. No. 7,392,772 B2 as cited in the introduction, and is only briefly summarized at this juncture. Illustrated in plan view are the camshaft 5 with the cam 4, the axle 2, the rocker arm 3, the secondary lever 4, the valve play compensating element 10, the lever support 6 and the outlet valve 11.

Figure 5:
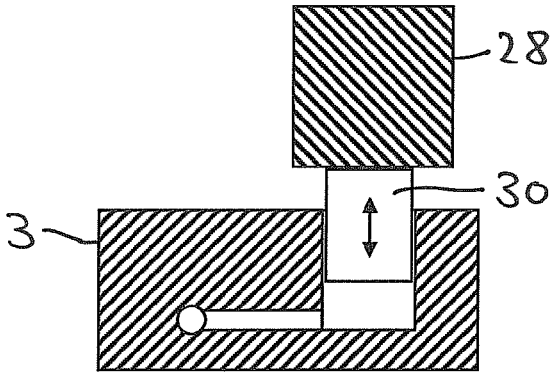
FIG. 5 shows the section II-II as per FIG. 4.

The re-opening of the outlet valve 11 during the compression stroke, as mentioned in the introduction, is generated by means of a separate braking cam 27 which is operatively connected to a further rocker arm which is denoted as brake lever 28. As can be seen from a juxtaposition with the section II-II illustrated in FIG. 5, the rocker arm 3 is provided with a lateral projection 29 which engages under the brake lever 28 with a hydraulically actuated coupling piston 30. Only during the engine braking mode is the coupling piston 30 situated in the illustrated deployed position, such that the pivoting movement of the brake lever 28 is transmitted via the coupling piston 30, the rocker arm 3 and the secondary lever 7 to the outlet valve 11.

It is also pointed out that the invention can be used not only with a rocker arm but rather also with an oscillating lever. The two lever types differ, as is known, in terms of the position of the pivot bearing, with the rocker arm being mounted not centrally but rather at the end side, and with the cam and the gas exchange valve accordingly running against the same lever section there.

Finally, it is also pointed out that, although the invention is preferably provided in connection with a decompression brake, this is not imperatively necessary. A valve drive according to the invention may in fact also be used in situations in which very high valve actuating forces must be overcome and hydraulic valve play compensation is nevertheless provided.

REFERENCE SYMBOLS

1 Valve drive
2 Pivot bearing/axle
3 Rocker arm
4 Cam
5 Camshaft
6 Lever support
7 Secondary lever
8 First lever section of the secondary lever
9 Second lever section of the secondary lever
10 Valve play compensating element
11 Outlet valve/gas exchange valve
12 Side wall of the rocker arm
13 Joint eyelet
14 Bearing eyelet
15 Radial opening
16 Recess
17 Channel
18 Axial bore
19 Rocker arm bore
20 Tappet rod
21 End of the tappet rod/lever-side joint head
22 End of the tappet rod/valve-side joint head
23 Joint socket of the secondary lever
24 Joint socket of the thrust piece
25 Thrust piece
26 Opening of the rocker arm
27 Brake cam
28 Brake lever
29 Lateral projection
30 Coupling piston

The invention claimed is:

1. A valve drive with a decompression brake for an internal combustion engine, comprising:

a camshaft with a cam;

a rocker arm for transmitting a cam stroke to a gas exchange valve a pivot bearing supporting the rocker arm; and a hydraulic valve play compensating element is being arranged in force flow between the cam and the gas exchange valve, wherein the valve play compensating element is arranged in a stationary fashion in the internal combustion engine, and the valve drive also comprises a secondary lever having a first lever section and a second lever section, the secondary lever being angularly connected, between the first lever section and the second lever section, to a lever support formed on the rocker arm and being supported with the first lever section on the valve play compensating element and actuating the gas exchange valve by means of the second lever section, with an effective lever arm of the first lever section being considerably larger than the effective lever arm of the second lever section.

2. The valve drive of claim 1, wherein the effective lever arm of the first lever section and the effective lever arm of the second lever section have a transmission ratio of at least 2:1.

3. The valve drive claim 1, wherein the rocker arm and the secondary lever are combined to form a captive structural unit.

4. The valve drive of claim 3, wherein the lever support is a joint pin which is fastened to and spans side walls of the rocker arm and, together with a joint eyelet, extends transversely through the secondary lever, forming a pin joint.

5. The valve drive of claim 1, wherein the pivot bearing is an axle running parallel to the camshaft and having a hydraulic-medium-conducting duct and a recess which holds the valve play compensating element and is connected to the duct.

6. The valve drive of claim 5, wherein the recess for the valve play compensating element is arranged in an axial region of a bearing eyelet, which engages around the pivot bearing of the rocker arm, and the bearing eyelet having a radial opening which serves as a clearance for the valve play compensating element and for the first lever section of the secondary lever.

7. The valve drive of claim 6, wherein the radial opening is a slot aligned in a circumferential direction of the bearing eyelet.

8. The valve drive of claim 1, wherein the valve drive further comprises a tappet rod arranged between the second lever section of the secondary lever and the gas exchange valve.

9. The valve drive of claim 8, wherein a valve-side end section of the rocker arm has an opening running in a direction of the gas-exchange valve and through the opening the tappet rod is guided.

10. The valve drive of claim 8, wherein both ends of the tappet rod are joint heads, with a lever-side joint head being held in a joint socket which runs on the second lever section of the secondary lever and with a valve-side joint head being held in a joint socket of a thrust piece which makes contact at an end side with the gas exchange valve.

* * * * *